United States Patent [19]

Kuokkanen

[11] Patent Number: 4,912,437

[45] Date of Patent: Mar. 27, 1990

[54] STRIPLINE CIRCUIT AND METHOD FOR REGULATING THE CHARACTERISTICS THEREOF

[75] Inventor: Lauri Kuokkanen, Kempele, Finland

[73] Assignee: Solitra Oy, Kempele, Finland

[21] Appl. No.: 275,350

[22] Filed: Nov. 22, 1988

[30] Foreign Application Priority Data

Nov. 23, 1987 [FI] Finland ..... 875160

[51] Int. Cl.[4] ..... H01P 1/00; H01P 7/08

[52] U.S. Cl. ..... 333/224; 333/235; 333/246; 333/263

[58] Field of Search ..... 333/205, 224, 226, 235, 333/238, 246, 263

[56] References Cited

U.S. PATENT DOCUMENTS 3,925,740 12/1975 Steensma ..... 333/226 X
4,281,302 7/1981 Stegens ..... 333/204
4,618,838 10/1986 Kajiwara et al. ..... 333/263 X

FOREIGN PATENT DOCUMENTS 0064000 6/1986 European Pat. Off. .
209901 9/1987 Japan ..... 333/235

*Primary Examiner*—Paul Gensler
*Attorney, Agent, or Firm*—Ladas & Parry

[57] ABSTRACT

The invention relates to a stripline circuit comprising a stripline structure of a high-conductive material disposed on the surface of a board of a dielectric material, as well as a method for regulating such a stripline circuit. The invention is characterized in that a metallic or metal coated cover (4) is non-conductively provided in the vicinity of the stripline structure (2), the distance of the cover from the stripline being adjustable to regulate the characteristic impedance of the stripline. The distance of the cover from the stripline is preferably adjusted by bending the cover (4).

8 Claims, 1 Drawing Sheet

STRIPLINE CIRCUIT AND METHOD FOR REGULATING THE CHARACTERISTICS THEREOF

Figure 1:
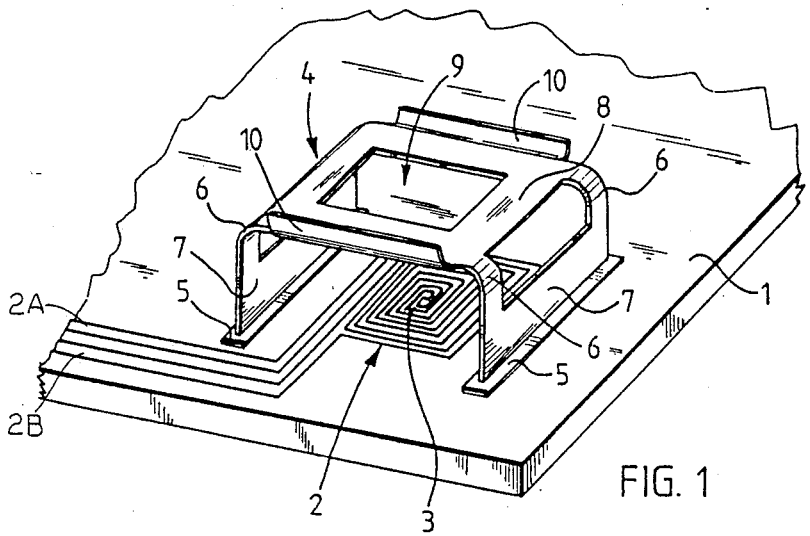

The present invention relates to a stripline circuit comprising a stripline structure of a high-conductive material disposed on the surface of a board of a dielectric material, and a method for regulating the characteristics—such as the resonant frequency of a stripline resonator shortened by means of a capacitance—of such a stripline circuit.

In high-frequency circuit implementations, savings are attained in costs and space by using stripline technology. Besides actual microwave applications, significant advantage may also be gained in meter and decimeter wave (VHF, UHF) circuit implementations. Along with the surface mounting technique, these devices have become and are ever becoming smaller in size.

Inductances are needed in many cases to implement high-frequency circuits. Often the inductance is small, but particularly in tuned circuits and filters the value must be very accurate. The cost for the capacitors needed in the circuits will increase, and they are more poorly accessible on account of the higher requirements on tolerances. Furthermore, the parameters of semiconductors vary owing to variations in production quality and may influence the frequency of resonance circuits. This condition is remedied by using either an adjustable capacitor or a coil having an adjustable inductance in the circuit. In comparison with fixed capacitors, adjustable capacitors are large in size and either unreliable with age or expensive. Adjustable inductances are also large in size and expensive.

An inductive reactance may be executed directly on the printed circuit board in connection with the other circuitry in the form of a stripline coil. When the length of the strip is substantial in relation to the wavelength, the strip may be regarded as a transmission line having an inductive reactance $$X_L = Z_o^* \tan\theta \tag{1}$$

wherein $Z_o$ is the characteristic impedance of the transmission line and $\theta \triangleq$ electric length of resonator $$= 360^\circ \cdot \frac{L}{\lambda}$$

when L=length of resonator and $\lambda$=wavelength. When $\theta < 90^\circ$, the resonance condition is achieved by adding a capacitance $C_L$ between the open ends of the transmission line (in an asymmetrical construction, between the open end and the "earth"). Seen from the reverse end of the transmission line, $$-j\frac{1}{\omega C_L} + jZ_o \tan\theta = 0$$

(series resonance), when the los is not taken into account. Seen from the capacitance end (open end), the transmission line being short-circuited at the other end (parallel resonance), $$\frac{jZ_o \tan\theta\left(-\frac{1}{\omega C_L}\right)}{j\left(Z_o \tan\theta - \frac{1}{\omega C_L}\right)} = \infty \text{ when } Z_o \tan = \frac{1}{\omega C_L}$$

$$\text{while } \theta = 360^\circ \cdot \frac{L}{\lambda} = 360^\circ \cdot \frac{L}{\frac{300}{f}} = 360^\circ \cdot \frac{f \cdot L}{300},$$

where f is the frequency in megahertz, L is the length of the transmission line in meters, and $C_L$ is the capacitance in picofarads. Then $$\frac{10^6}{2\pi f C_L} = Z_o \tan\left(\frac{360^\circ}{300} \cdot f \cdot L\right), \text{ wherefrom} \tag{2}$$

$$Z_o = \frac{10^6}{2\pi f C_L \tan\left(\frac{360^\circ}{300} \cdot f \cdot L\right)}$$

Thus, in accordance with equation (2) the resonant frequency may be adjusted by varying the characteristic impedance $Z_o$ of the transmission line, but certainly also by varying the supplementary capacitance $C_L$ or the length L of the line.

Thus, in accordance with the invention, the regulation of the characteristics of the stripline circuit is achieved by adjusting the characteristic impedance of the stripline in such a manner that a metallic or metal coated cover is non-conductively placed in the vicinity of the stripline structure, the distance of the cover from the stripline structure being adjusted. The stripline circuit of the invention is characterized by a stripline pattern as disclosed hereinafter.

Therefore, the basic concept according to the invention is to place above the stripline pattern a metallic or metal coated cover, whereby a variation in the characteristic impedance of the stripline is produced by moving the cover, and this variation together with the stray capacitance or other capacitance present at the open end of the stripline changes the electric resonant frequency of the structure e.g. for control purposes.

With the method and structure of the invention, variations in the manufacturing tolerances of transmission lines and also variations in the capacitor tolerances and other constants for the circuit can easily and economically be compensated for. Furthermore, the cover affords adequate protection, and thus the component density may be increased by placing several circuits side by side. Also, the losses in the coils are moderate.

Figure 2:
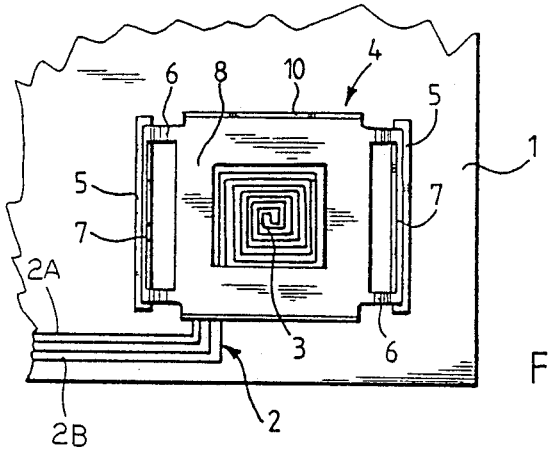
Figure 3:
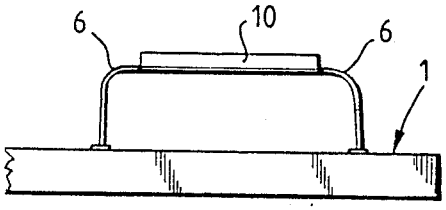
Figure 4:
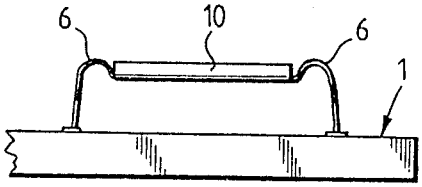

The following is a more detailed description of the invention with reference to the embodiment of the accompanying drawing, wherein FIG. 1 is a perspective view of a resonator structure of the invention with the cover in the upper position, FIG. 2 is a top view of the structure of FIG. 1, FIG. 3 is a side view of the structure of FIG. 1, and FIG. 4 shows the structure of the invention with the cover bent downward from the position shown in FIG. 3.

In the structure shown in FIGS. 1 to 3, a stripline structure 2 is furnished on the surface of a dielectric board 1, the stripline structure comprising an unbroken stripline forming a resonator in the form of a spiral-like pattern having a centrally positioned free end. At such free end, the plate 3 of a load capacitance $C_L$ is provided. The stripline circuit 2 further includes terminal leads 2A and 2B for connecting the resonator circuit to other circuits (not shown) on the circuit board. The dielectric board may be e.g. of Teflon insulated fiberglass laminate, but the material has no essential significance for the actual inventive concept. A metallic or metal-coated cover 4 standing freely on its legs and having substantially a rectangular shape is disposed about the stripline structure 2 so as not to be in galvanic contact with the stripline structure 2. The cover is disposed on metal strips 5 of its own and soldered thereto. The cover includes at each corner support legs 6 interconnected with support elements 7 on two opposite sides. The upper part of the cover is constituted by an upper plane 8 essentially parallel with the dielectric board 1, having an aperture 9 in the middle region thereof. Upwardly bent lugs 10 are provided at the two opposite lateral edges of the upper plane 8. The cover spans the entire stripline pattern, i.e., that portion of the stripline circuit which essentially defines the characteristics of the stripline circuit-a resonator in this embodiment of the invention. The terminal leads 2A and 2B extend outwardly from under the cover.

On account of the thin support legs 6, the upper plane 8 may be raised and lowered relative to the surface of the dielectric board 1. FIG. 4 shows the cover 4 in a position where the upper plane 8 has been pushed downward as compared with the position shown in FIG. 3. The thin support legs 6 bend as shown in the figure, whereby the distance of the upper plane of the cover from the dielectric board 1 can easily be adjusted. A change in the distance between the cover and the dielectric board will produce a change in the characteristic impedance of the stripline, which together with the capacitance provided at the open end of the stripline will alter the electric resonant frequency of the structure. The distance between the cover and the dielectric board typically varies between 0.5 and 2 mm.

Even though the invention has been explained in the foregoing with reference to the embodiment of the accompanying drawing, it is evident that the invention is not restricted to said embodiment but may be modified in many ways. Actually the characteristic impedance of the stripline may be adjusted in accordance with the invention also for other purposes than for the regulation of the resonant frequency. Also the structure of the cover may be reaized in many variations, as can the manner in which the cover is moved closer to and away from the stripline. However, the easiest adjustment is achieved by constructing the cover in the manner disclosed above, i.e. so that the adjustment can be achieved by altering the form of the cover.

What is claimed is:

1. A method for adjusting the characteristic impedance of a stripline circuit, said stripline circuit comprising an unbroken stripline of a high-conductive material disposed on the surface of a board of a dielectric material in the form of a pattern essentially defining the characteristics of the circuit, the method comprising the steps of placing a metallic or metal-coated cover above and conductively separated from said stripline pattern at a distance from it and in such a way that it spans the entire pattern, and adjusting the distance of the cover from the stripline.

2. A method as claimed in claim 1, wherein the distance of the cover from the stripline is regulated by bending the cover.

3. A method as in claim 1 in which said pattern has a spiral-like shape.

4. A stripline circuit comprising an unbroken stripline of a high-conductive material disposed on the surface of a board of a dielectric material in the form of a pattern essentially defining the characteristics of the circuit, and a metallic or metal-coated cover provided above and conductively isolated from said stripline pattern and so disposed that it spans the entire pattern, the distance of the cover from the stripline being adjustable to regulate the characteristic impedance of the stripline.

5. A stripline circuit as in claim 4 wherein said pattern has a spiral-like shape.

6. A stripline circuit as in claim 4 wherein the area of said board encompassed by said cover includes only elements integral to said unbroken stripline.

7. A stripline circuit as in claim 4 wherein said cover comprises an apertured plate disposed over said pattern and having dependent legs mounted on portions of said board outside the periphery of said pattern.

8. A stripline circuit as in claim 4 wherein a projection of the periphery of said cover onto said board entirely encompasses said pattern.

* * * * *